United States Patent [19]

Thur et al.

[11] 3,943,950

[45] Mar. 16, 1976

[54] CHANGE DISPENSER ANTI-JAM DEVICE

[75] Inventors: Gerry W. Thur, Oconomowoc, Wis.; Peter H. DeGraff, Ithaca, N.Y.

[73] Assignee: NCR Corporation, Dayton, Ohio

[22] Filed: Feb. 12, 1975

[21] Appl. No.: 549,423

[52] U.S. Cl. ..... 133/4 A; 192/56 L

[51] Int. Cl.[2] ..... G07D 1/00

[58] Field of Search..... 194/1; 133/3 R, 3 A–3 H, 133/4 R, 4 A; 64/29; 192/56 L, 56 R

[56] References Cited

UNITED STATES PATENTS

| | | | |
|---|---|---|---|
| 3,145,827 | 8/1964 | Bonsignore | 64/29 X |
| 3,487,902 | 1/1970 | Persson et al. | 133/3 R X |
| 3,561,576 | 2/1971 | Lutz | 192/56 L |

*Primary Examiner*—Allen N. Knowles
*Attorney, Agent, or Firm*—J. T. Cavender; Wilbert Hawk, Jr.; Richard W. Lavin

[57] ABSTRACT

A drive mechanism is disclosed for use in a change dispensing apparatus for automatically relieving a jam-up of the dispensing mechanism. The drive mechanism includes a drive shaft having a cam member secured to one end, a driven shaft with a support member secured thereto and positioned adjacent the cam member, a pair of arm members rotatably mounted on the support member and which are spring urged into engagement with the cam member to transmit the rotation of the drive shaft to the driven shaft. Upon the stopping or slowing down of the driven shaft, the cam member will rotate with respect to the support member thereby rotating the arm members against the action of the springs until the torque exerted by the springs is greater than the torque by the cam member on the arm members resulting in a reverse rotation of the support member and the driven shaft which rotation acts to relieve the jam-up of the dispensing mechanism which caused the stopping of the driven shaft.

22 Claims, 5 Drawing Figures

CHANGE DISPENSER ANTI-JAM DEVICE

FIELD OF THE INVENTION

This invention relates to a drive mechanism for use in operating a coin dispensing apparatus and more particularly to a drive mechanism having the capability of automatically relieving a jam-up of the dispensing apparatus.

BACKGROUND OF THE INVENTION

Prior jam detecting devices for use in coin dispensing apparatus have been limited to the function of detecting the jam and stopping the operation of the dispensing apparatus thereby requiring the operator to open up the cover and remove the cause of the jam which may be a bent or mutilated or otherwise defective coins and associated foreign matter. This has required the change dispenser to be positioned on the check-out counter which is readily accessible to the operator. This condition has also required that the change dispensing apparatus be designed so that there is easy accessibility to the coin transport area of the apparatus which requirement also increases the cost of the apparatus. With today's shift to modular layout in checkout design, there is increasing pressure to position the change dispenser apparatus within the confines of the checkout counter which location prevents ready accessibility to the change dispenser in case a jam-up of the mechanism occurs.

SUMMARY OF THE INVENTION

It is therefore an object of this invention to provide a mechanism for use in a coin dispensing apparatus which atuomatically relieves a coin jam condition of the apparatus. It is a more particular object of this invention to provide a drive mechanism for a coin dispenser which functions to automatically eliminate a jam condition in the coin dispenser. In order to carry out these objects, there is provided a drive shaft having a cam member secured to one of its ends, a driven shaft member operating the change dispensing mechanism and having a support member secured to its end, the support member positioned adjacent the cam member, and a pair of arm members rotatably mounted on the support member and spring urged into engagement with the cam member to transmit the torque of the drive shaft to the driven shaft. Upon the stopping or slowing down of the driven shaft due to a jamming condition in the coin dispenser, the cam member will continue to rotate with respect to the support member which action will cam the arms about their pivot point on the support member until the arms are positioned on the cam member at an angle which allows the springs to snap back each of the arms into a home position on the cam member. This snap back movement constitutes a reverse torque movement to the support member and the driven shaft resulting in the rotation of the driven shaft in a reverse direction to relieve the jamming condition in the coin dispenser. If the driven shaft is still jammed after the first reverse movement, the cam member will be again rotated with respect to the support member to set up another reverse movement of the driven shaft. This reverse operation of the driven shaft will automatically continue until the jam condition is eliminated.

DESCRIPTION OF THE PREFERRED EMBODIMENT

Figure 1:
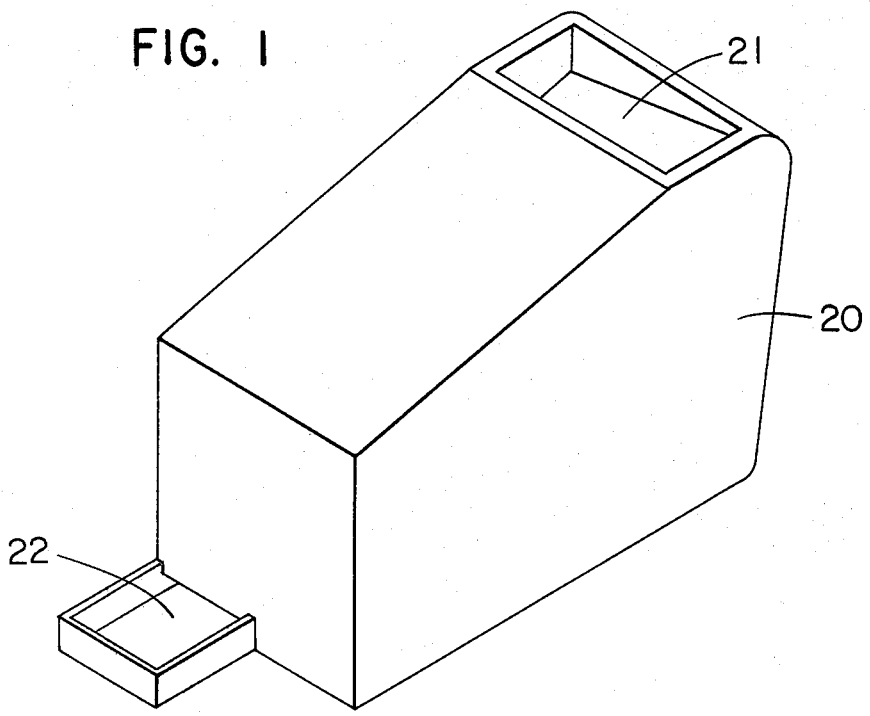
FIG. 1 is a perspective view of the coin sorter and dispenser embodying the present invention.

Referring now to FIG. 1, there is shown a perspective view of a coin sorter-changer apparatus 20 which utilizes the present invention. The sorter-changer includes an inclined coin input cup 21 and a coin output cup 22. Loose mixed coins deposited in the cup 21 will fall edgewise into an inclined chute 23 (FIG. 2) located within the sorter-changer apparatus 20. The coins will roll edgewise under the influence of gravity down the chute 23 where each coin denomination will be sorted by engaging one of a plurality of abutments 24 extending from the side of the chute 23. Each abutment 24 is positioned at a different height from the bottom of the chute 23 to engage a predetermined coin denomination in a manner that is well known in the art.

Figure 2:
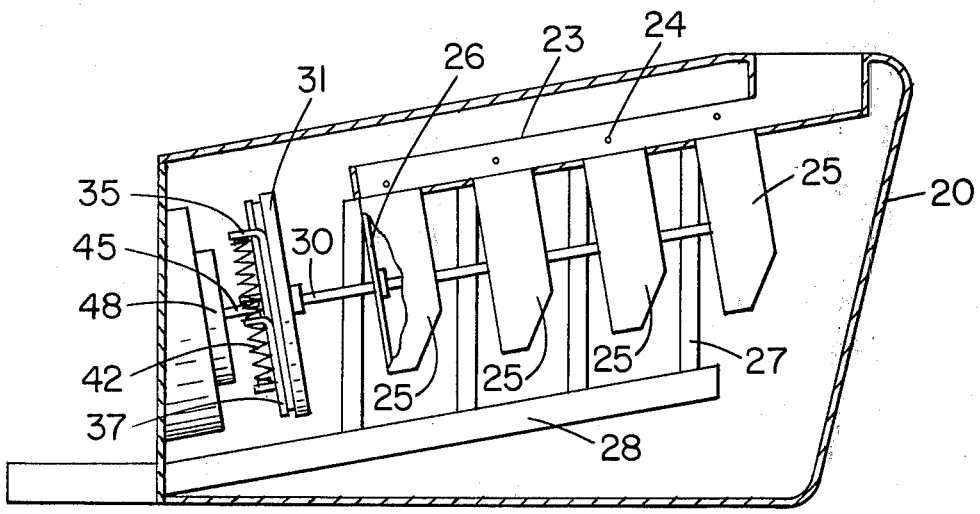
FIG. 2 is a detailed sectional side view of the coin sorter and dispenser showing the various coin dispensing mechanisms and the drive system for the dispensing mechanism.

Each coin denomination deflected from the chute 23 will fall into an associated coin hopper 25 of the type disclosed in U.S. Pat. No. 3,788,334 issued to I. B. Saraceno et al. on Jan. 29, 1974 and assigned to the present assignee. As disclosed in this patent, rotatably mounted in each of the coin hoppers 25 is a transport disc 26 having a plurality of apertures (not shown) the size of which accommodate one of the coin denominations deposited in the hopper 25. Rotation of the disc will transport coins in the apertures from the bottom of the hopper 25 to the entrance of corresponding dispensing coin chute 27 for delivery to the coin output cup 22 by means of a coin chute extension 28 into which each of the coin chutes 27 are connected. As shown in FIG. 2, there are four coin hoppers 25 which accommodate four different size coins, i.e. pennies, nickels, dimes and quarters.

Each of the transport discs 26 are secured to a driven shaft 30 journaled within the apparatus. Secured to the end of the driven shaft 30 is a support member 31 (FIGS. 2, 3 and 4) to which is mounted a pair of studs 32, 33. Positioned on the studs 32, 33 is a spring support member 34 having a pair of bent over flange portions 35. Mounted to each flange portion 35 is a stud 36 which functions to position a spring as will be described more fully hereinafter.

Figure 3:
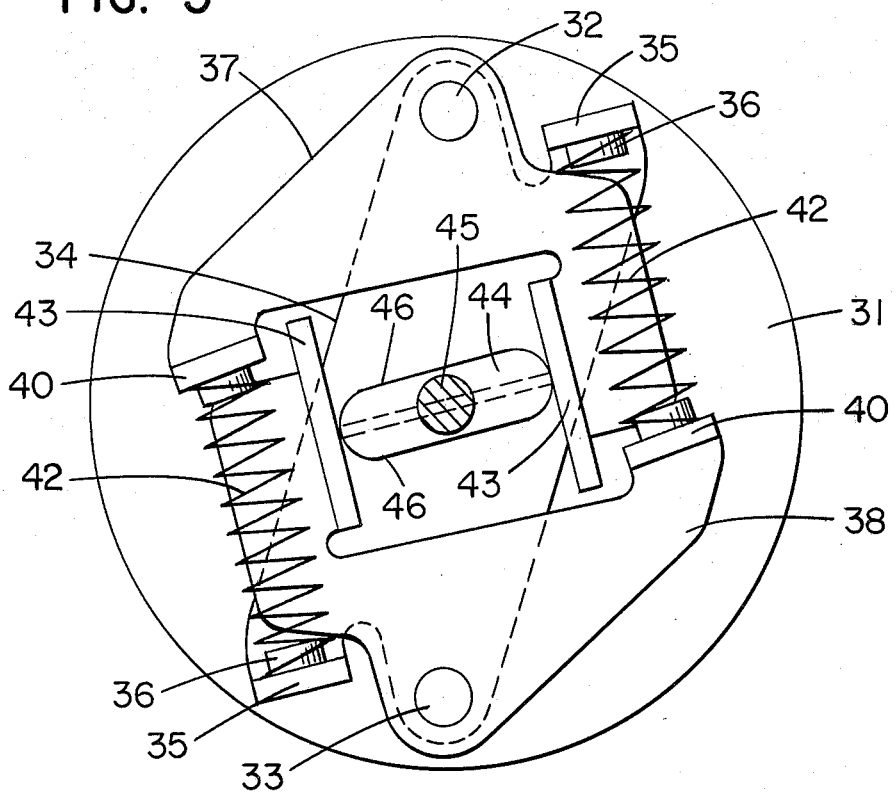
FIG. 3 is a detailed sectional plan view of the reversing coupling showing the coupling at the start of its reversing operation.
Figure 4:
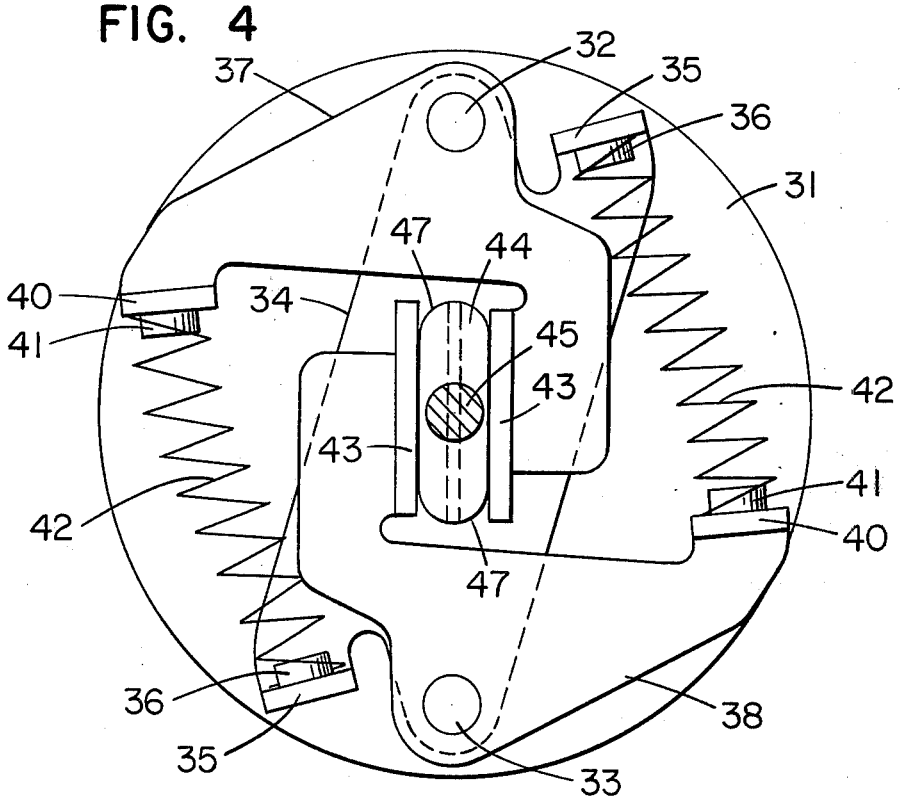
FIG. 4 is similar to FIG. 3 showing the coupling in its home position engaging the drive cam member.

Rotatably positioned on the stud 32 is a rocker arm 37 while a similar rocker arm 38 is rotatably positioned on stud 33. Each of the rocker arms 37, 38 has a bent over flange portion 40 to which is mounted a stud 41. As shown in FIGS. 3 and 4, mounted between the flange portions 40 of the rocker arms 37, 38 and the flange portions 35 of the support member 34 are a pair of compression springs 42 which normally urges each of the rocker arms 37, 38 in a clockwise direction about the studs 32, 33.

As shown in FIGS. 3 and 4, each of the rocker arms 37, 38 has a second bent over flange portion 43 which is positioned adjacent a cam member 44 pinned to one end of a drive shaft 45. While the cam member 44 shown in FIGS. 3 and 4 has a pair of opposite flat elongated surfaces 46 and a pair of opposite circular surfaces 47, it is obvious that other types of cam configuration can be used in the practice of this invention to accomplish the intended purpose. Rotation of each of the rocker arms 37, 38 in a clockwise direction by the springs 42 will normally position the flange portions 43 of the rocker arms into engagement with the flat elongated surfaces 46 of the cam member 44 as shown in FIG. 4. Rotation of the cam member 44 by the drive shaft 45 will result in the rotation of the rocker arms, the support member 31 and the driven shaft 30 by the action of the springs 42 on the rocker arms.

As shown in FIG. 2, the drive shaft 45 is associated with a motor 48 mounted to the front portion of the change apparatus 20. In operation, the motor 48 will rotate the drive shaft 45 and the cam member 44 clockwise which movement is transmitted to the driven shaft 30 through the rocker arms 37, 38 and the springs 42. Upon the occurrence of a jam-up in one of the hoppers 25, the driven shaft 30 will stop or be retarded in its rotation. Stopping of the shaft 30 and the support member 31 will result in the rocker arms 37, 38 being rotated counter-clockwise about the studs 32, 33 against the action of the springs 42 by the rotation of the cam member 44. The compressing of the springs 42 by the movement of the rocker arms 37, 38 will build up energy in the springs until the cam members reach the position shown in FIG. 3 in which the center of the circular surface 47 is perpendicular to the flange portions 43. Further clockwise movement of the cam member 44 will position the flange portion 43 on the circular surface 44 of the cam member such that the force movement exerted on the rocker arms by the spring 42 will be greater than that exerted by the cam member 44 resulting in the attempted movement of the rocker arms 37, 38 in a clockwise direction. Since this clockwise movement of the rocker arm is restricted by the position of the cam member 44 with respect to the flange portions 43 of the rocker arm, this attempted clockwise movement of the rocker arms is transmitted to the support member 31 and the driver shaft 30 in the form of a reverse torque resulting in the counterclockwise rotation of the support member 31 and the shaft 30. This reverse movement of the shaft 30 will continue until the rocker arms have assumed the home position shown in FIG. 4.

The reverse rotation of the shaft 30 will be transmitted to the transport disc 26 in each of the hoppers 25 which movement acts to relieve the cause of the jam-up. If the first reverse movement of the shaft 30 fails to eliminate the cause of the jam-up, the cam member 44 will again be rotated in a clockwise direction with respect to the rocker arm 37, 38 and the support member 31 to set up another reverse rotation of the shaft 30. This sequence of reverse movements will automatically occur as long as the shaft 30 is restricted from moving with the cam member 44.

Figure 5:
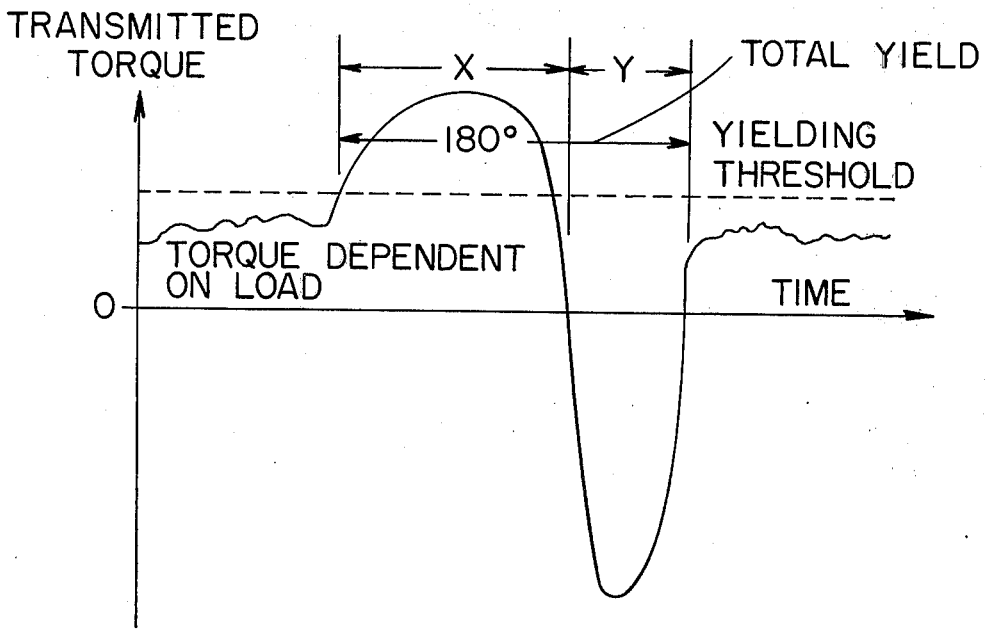
FIG. 5 is a diagrammatic representation of the torque transmitted by the coupling mechanism.

Referring to FIG. 5, there is shown diagrammatically the torque generated by the coupling during a jam-up condition. It will be seen that since the energy is stored in the springs 42 during an X distance of rotation of the cam member from its home position which is greater than 90° but less than 180° and is released during a Y distance of rotation which is less than 90°, the reverse torque peak value is considerably higher than the buildup torque, thus providing a greater chance of eliminating the cause of the jam-up during the first reverse movement of the shaft 31. It will thus be seen from this construction that the drive shaft 45 rotates continuously and that the reversing action is completely contained in the coupling which automatically resumes normal operation once the jam-up is eliminated by one or more torque reversing cycles of the coupling.

While the invention has been particularly shown and described with reference to preferred embodiments thereof, it will be understood by those skilled in the art that the foregoing and other changes in the form and detail may be made therein without departing from the sphere and scope of the invention.

What is claimed is:

1. A change dispensing apparatus, including
   a. driving means rotatable in a first direction around an axis;
   b. driven means rotatable in said first direction to operate the dispensing apparatus;
   c. means for transmitting the rotational movement of said driving means to said driven means to operate the dispensing apparatus including support means secured to said driven means, said support means extending outwardly from said axis;
   d. a drive member secured to said driving means and positioned adjacent said support means;
   e. a connecting member mounted on said support means away from said axis for movement in a direction perpendicular to said axis;
   f. and an actuating member secured to said support means and engaging said connecting member for moving said connecting member into a first engaging position with said drive member to provide a first rotational force on said connecting member which will allow the actuating member to transmit the rotational movement of said drive member to said support means, said drive member moving said connecting member to a second engaging position on said drive member against the action of said actuating member upon the stopping of said support means, said connecting member forming an angle with said drive member upon further movement of said drive member wherein said actuating member will provide a second rotational force on said connecting member which is greater than and opposite to said first rotational force whereby said connecting member and said support means will be rotated in a direction reverse to the first direction of said driven means to return the connecting member to said first engaging position.

2. The change dispensing apparatus of claim 1 in which said actuating member comprises a spring member for providing a first rotational force on said connecting member which rotates said connecting member into said first engaging position on said drive member to transmit the movement of said drive member to said support means, said drive member rotating said connecting member against the action of the spring member upon the stopping of the support means to move the connecting member to said second engaging position, the connecting member forming an angle with the drive member whereby further movement of the drive member will position the connecting member to allow the spring member to rotate the support means and the connecting member in a direction reverse to the direction of movement of said drive member to return the connecting members to said first engaging position.

3. The change dispensing apparatus of claim 2 in which said drive member comprises a cam member having a first engaging surface extending along a first axis and a second engaging surface extending along a second axis, and said connecting member has an engaging surface which is parallel to said first engaging surface of the cam member when the connecting member is in said first engaging position and parallel to the second engaging surface of the cam member when the connecting member is in said second engaging position whereby further movement of the cam member will allow the spring member to move the connecting member and the support means in a reverse direction to position said first engaging surface of said cam member adjacent the engaging surface of said connecting member.

4. The change dispensing apparatus of claim 3 in which said driving means is rotatably disposed and in which said first axis of the cam member is perpendicular to said second axis, said cam member being rotated more than 90° from said first engaging position before the spring member will move the connecting member and the support means in a reverse direction.

5. The change dispensing apparatus of claim 4 in which the engaging surface of said connecting member and said first engaging surface of said cam member comprises an elongated flat surface while said second engaging surface of said cam member comprises a circular surface, said spring member rotating said connecting member and said support means in a reverse direction upon movement of the center of said circular surface, through the point of contact between the engaging surface of said connecting member and the circular surface of said cam member.

6. The change dispensing apparatus of claim 5 in which said spring member comprises a compression spring mounted between the support means and said connecting member whereby continued movement of the cam member after the stopping of the support means will compress the spring until the connecting member is positioned on the cam member allowing the force of the compressed spring on the connecting member to overcome the force of the cam member on the connecting member.

7. A change dispensing apparatus including:

a. a constantly rotating drive shaft;

b. a rotatably mounted driven shaft engaging a change dispensing mechanism for actuating said mechanism when operated;

c. a laterally extending support member secured to the end of said driven shaft;

d. a cam member secured to the end of said drive shaft and positioned adjacent said support member;

e. a plurality of oppositely disposed cam follower arms rotatably mounted on said support member for movement towards and away from said cam member;

f. and a plurality of resilient actuating members each engaging one of said arms and mounted on said support member for normally rotating said arms towards said cam member into an actuated position on said cam member to apply a first torsional force on said cam member thereby transmitting the movement of said drive shaft to said driven shaft to operate said change dispensing mechanism, said cam member, upon the stopping of said change dispensing mechanism and said support member, rotating said follower arms outwardly to an extended position against the action of said actuating member, the arms in said extended position forming an angle with said cam member for releasing the actuating member whereby said actuating members will apply a second torsional force on said arms and said cam member which is greater than and opposite to said first torsional force to rotate said arms and said support member in a direction opposite to the movement of said cam member to return the arms to said actuated position on said cam member.

8. The change dispensing apparatus of claim 7 in which said cam member has a first engaging surface extending along a first axis and a second engaging surface extending along a second axis perpendicular to said first axis, said first engaging surface being longer than said second surface and engaging said arm member when the arm member in said actuated position, said cam member rotating said arm members upon the stopping of said support member to said extended position wherein said second engaging surface will engage said arm members, whereby further rotation of said cam member will allow said actuating members to rotate said support member in an opposite direction to the movement of said cam member to position the arm members in said actuated position.

9. The change dispensing apparatus of claim 8 in which the cam member is rotated through an angle of more than 90° prior to the release of said actuating member for rotating the support member in a reverse direction.

10. The change dispensing apparatus of claim 8 in which said resilient actuating member comprises a compression spring mounted between said support member and an associated cam follower arm for normally rotating said arms into engagement with said cam member, said springs being compressed by the rotation of the cam member upon the stopping of said support member until the arms are positioned at an angle with said cam member whereby the force of said compressed spring on said arms will rotate said support member in a direction reverse to the movement of said cam member.

11. The change dispensing apparatus of claim 10 in which the first axis of said cam member is perpendicular to the engaging surface of said arm when in said extended position whereby further rotation of the cam member will allow the compressed springs to rotate said arms and said support member in a direction reverse to the rotation of the cam member to position the arms in said actuated position.

12. A change dispensing mechanism comprising a. a driving member for exerting a torque about an axis in an operating direction;

b. means for operating the dispensing mechanism when moved in said operating direction;

c. means for relieving the jamming of the dispensing mechanism including support means secured to said operating means;

d. and spring actuated coupling members rotatably mounted on said support means for movement in a direction perpendicular to said axis, said coupling means engaging said driving member for transmitting the torque of said driving member to said operating means, said driving member rotating said coupling members away from said axis to a position on said support means against the action of the springs upon the stopping of the support means to exert a torque on said support means which is greater than and is reverse to the torque exerted by said driving member whereby said support means is moved by said coupling members in a direction opposite to said operating direction to relieve the jamming of the change dispensing mechanism.

13. A method for releasing the jam condition of a change dispensing mechanism comprising the steps of:

a. rotating the drive shaft of a change dispensing mechanism and a support member secured thereto in an operating direction;

b. moving a pair of spring urged coupling members rotatably mounted on the support member in said operating direction;

c. rotating the coupling members against the action of their springs to a cocked position on the support member upon the stopping of the support member;

d. and rotating the coupling members and the support member under the action of the springs in a direction opposite to said operating direction to rotate the drive shaft in a jam releasing direction.

14. A method for relieving the jam condition of a change dispensing mechanism comprising the steps of:

a. rotating an input drive shaft having an actuating member secured thereto in an operating direction;

b. moving a pair of spring urged coupling members rotatably mounted on a support member secured to a change dispensing mechanism drive shaft into engagement with the actuating member, to rotate the dispensing mechanism drive shaft in said operating direction;

c. stopping the support member upon the occurrence of a jam condition in the dispensing mechanism;

d. further rotating said actuating member upon the stopping of the support member;

e. rotating the coupling members against the action of their springs to a cocked position on said support member upon the stopping of said support member;

f. releasing the coupling members to the action of the springs when in said cocked position;

g. and rotating said coupling members and said support member in a direction opposite to the direction of the actuating member to rotate the dispensing mechanism drive shaft in a jam releasing direction.

15. A change dispensing apparatus, including:

a. driving means movable in a first direction;

b. driven means movable in said first direction to operate the dispensing apparatus;

c. means for transmitting the movement of said driving means to said driven means to operate the dispensing apparatus including support means secured to said driven means;

d. a cam member secured to said driving means, said cam member having a first engaging surface extending along a first axis and a second engaging surface extending along a second axis;

e. a connecting member rotatably mounted on said support means, said connecting member having an engaging surface;

f. and a spring member secured to said support means and engaging said connecting member for rotating said connecting member into a first engaging position on said cam member to transmit the movement of said cam member to said support means wherein the engaging surface of said connecting member is parallel to said first engaging surface of the cam member, said cam member rotating said connecting member to a second engaging position on said cam member against the action of said spring member upon the stopping of said support means wherein the engaging surface of said connecting member is parallel to said second engaging surface of the cam member whereby further movement of the cam member will allow the spring member to move the connecting member and the support means in a direction reverse to the first direction of said driven means to position said first engaging surface of said cam member adjacent the engaging surface of said connecting member.

16. The change dispensing apparatus of claim 15 in which said driving means is rotatably disposed and in which said first axis of the cam member is perpendicular to said second axis, said cam member being rotated more than 90° from said first engaging position before the spring member will move the connecting member and the support means in a reverse direction.

17. The change dispensing apparatus of claim 16 in which the engaging surface of said connecting member and said first engaging surface of said cam member comprises an elongated flat surface while said second engaging surface of said cam member comprises a circular surface, said spring member rotating said connecting member and said support means in a reverse direction upon movement of the center of said circular surface, through the point of contact between the engaging surface of said connecting member and the circular surface of said cam member.

18. The change dispensing apparatus of claim 17 in which said spring member comprises a compression spring mounted between the support means and said connecting member whereby continued movement of the cam member after the stopping of the support means will compress the spring until the connecting member is positioned on the cam member allowing the force of the compressed spring on the connecting member to overcome the force of the cam member on the connecting member.

19. A change dispensing apparatus including:

a. a constantly rotating drive shaft;

b. a rotatably mounted driven shaft engaging a change dispensing mechanism for actuating said mechanism when operated;

c. a support member secured to the end of said driven shaft;

d. a cam member secured to the end of said drive shaft and positioned adjacent said support member, said cam member having a first engaging surface extending along a first axis and a second engaging surface extending along a second axis perpendicular to said first axis, said first engaging surface being longer than said second engaging surface;

e. a plurality of cam follower arms rotatably mounted on said support member;

f. and a plurality of resilient actuating members each engaging one of said arms and mounted on said support member for normally urging said arms into an actuated position on said cam member wherein said first engaging surface of the cam member engages said arm member to transmit the movement of said drive shaft to said driven shaft to operate said change dispensing mechanism, said cam member, upon the stopping of said change dispensing mechanism and said driven shaft, rotating said follower arms to an extended position against the action of said actuating member wherein said second engaging surface will engage said arm members, the arms in said extended position forming an angle with said cam member whereby further rotation of said cam member will allow said actuating members to rotate said arms and said support member in a direction opposite to the movement of said cam member to position the arms in said actuated position on said cam member.

20. The change dispensing apparatus of claim 19 in which the cam member is rotated through an angle of more than 90° prior to the release of said actuating member for rotating the support member in a reverse direction.

21. The change dispensing apparatus of claim 19 in which said resilient actuating member comprises a compression spring mounted between said support member and an associated cam follower arm for normally rotating said arms into engagement with said cam member, said springs being compressed by the rotation of the cam member upon the stopping of said support member until the arms are positioned at an angle with said cam member whereby the force of said compressed spring on said arms will rotate said support member in a direction reverse to the movement of said cam member.

22. The change dispensing apparatus of claim 21 in which the first axis of said cam member is perpendicular to the engaging surface of said arm when in said extended position whereby further rotation of the cam member will allow the compressed springs to rotate said arms and said support member in a direction reverse to the rotation of the cam member to position the arms in said actuated position.

* * * * *